US008572789B2

(12) United States Patent
Horne

(10) Patent No.: US 8,572,789 B2
(45) Date of Patent: Nov. 5, 2013

(54) SEPARATING APPARATUS

(75) Inventor: Lucas Horne, Malmesbury (GB)

(73) Assignee: Dyson Technology Limited, Malmesbury (GB)

( * ) Notice: Subject to any disclaimer, the term of this patent is extended or adjusted under 35 U.S.C. 154(b) by 311 days.

(21) Appl. No.: 12/836,334

(22) Filed: Jul. 14, 2010

(65) Prior Publication Data

US 2011/0016660 A1 Jan. 27, 2011

(30) Foreign Application Priority Data

Jul. 24, 2009 (GB) ..... 0912933.9

(51) Int. Cl.
*A47L 13/40* (2006.01)

(52) U.S. Cl.
USPC ..... 15/1.51; 15/353; 55/337; 55/346; 96/54

(58) Field of Classification Search
USPC ..... 15/1.51, 353; 55/337, 343, 346, 349, 55/459.1, DIG. 3; 96/15, 54, 74
See application file for complete search history.

(56) References Cited

U.S. PATENT DOCUMENTS

| | | | |
|---|---|---|---|
| 2,081,772 | A | 5/1937 | Saint-Jacques |
| 2,569,710 | A | 10/1951 | Fitzpatrick |
| 2,711,226 | A | 6/1955 | Davis, Jr. |
| 2,864,460 | A | 12/1958 | Powers |
| 3,398,082 | A | 8/1968 | Lochmann et al. |
| 3,526,081 | A | 9/1970 | Kusters |
| 4,010,011 | A | 3/1977 | Reif |
| 4,133,653 | A | 1/1979 | Soltis |
| 4,309,199 | A | 1/1982 | Suzuki |
| 4,352,681 | A | 10/1982 | Dietz |
| 4,370,155 | A | 1/1983 | Armbruster |
| 4,478,613 | A | 10/1984 | Brettschneider et al. |
| 4,507,131 | A | 3/1985 | Fathauer et al. |
| 4,541,847 | A | 9/1985 | Oie et al. |
| 4,718,923 | A | 1/1988 | Haag et al. |
| 4,726,825 | A | 2/1988 | Natale |
| 4,826,515 | A | 5/1989 | Dyson |
| 4,853,011 | A | 8/1989 | Dyson |

(Continued)

FOREIGN PATENT DOCUMENTS

| | | |
|---|---|---|
| CA | 714367 | 7/1965 |
| CN | 2548689 | 5/2003 |

(Continued)

OTHER PUBLICATIONS

GB Search Report dated Oct. 27, 2009, directed to GB Application No. 0912933.9; 2 pages.

(Continued)

*Primary Examiner* — Brian Glessner
*Assistant Examiner* — Brian D Mattei
(74) *Attorney, Agent, or Firm* — Morrison & Foerster LLP

(57) ABSTRACT

The present invention relates to a separating apparatus for separating particles from a fluid flow. Particularly, but not exclusively, the invention relates to a vacuum cleaner having such a separating apparatus for removing dust particles from a dust laden airstream. The separating apparatus includes a first cyclonic cleaning stage including at least one cyclone, and an electrostatic filter located downstream of and in fluid communication with the at least one cyclone, wherein at least a portion of the electrostatic filter is located longitudinally through the separating apparatus, at least a portion of the first cyclonic cleaning stage being arranged around the electrostatic filter.

18 Claims, 8 Drawing Sheets

(56) References Cited

U.S. PATENT DOCUMENTS

| | | | | |
|---|---|---|---|---|
| 4,973,341 | A | 11/1990 | Richerson | |
| 5,143,524 | A | 9/1992 | Inculet et al. | |
| 5,230,722 | A | 7/1993 | Yonkers | |
| 5,248,323 | A | 9/1993 | Stevenson | |
| 5,405,434 | A | 4/1995 | Inculet | |
| 5,474,599 | A | 12/1995 | Cheney et al. | |
| 5,582,632 | A | 12/1996 | Nohr et al. | |
| 5,593,476 | A | 1/1997 | Coppom | |
| 5,647,890 | A | 7/1997 | Yamamoto | |
| 5,651,811 | A | 7/1997 | Frey et al. | |
| 5,683,494 | A | 11/1997 | Altman et al. | |
| 5,755,333 | A | 5/1998 | Stencel et al. | |
| 5,855,653 | A | 1/1999 | Yamamoto | |
| 6,003,196 | A * | 12/1999 | Wright et al. | 15/353 |
| 6,197,096 | B1 | 3/2001 | Cartellone | |
| 6,228,148 | B1 | 5/2001 | Aaltonen et al. | |
| 6,245,126 | B1 | 6/2001 | Feldman et al. | |
| 6,482,252 | B1 | 11/2002 | Conrad et al. | |
| 6,572,685 | B2 | 6/2003 | Dunshee | |
| 6,709,495 | B1 | 3/2004 | Storer | |
| 6,740,144 | B2 | 5/2004 | Conrad et al. | |
| RE39,473 | E * | 1/2007 | Salo et al. | 15/353 |
| 7,156,902 | B1 | 1/2007 | Altman | |
| 7,179,314 | B2 | 2/2007 | Conrad et al. | |
| 7,311,747 | B2 | 12/2007 | Adamek et al. | |
| 7,497,899 | B2 | 3/2009 | Han et al. | |
| 7,507,269 | B2 | 3/2009 | Murphy et al. | |
| 7,547,336 | B2 | 6/2009 | Fester et al. | |
| 7,556,662 | B2 | 7/2009 | Lee et al. | |
| 7,708,813 | B2 | 5/2010 | Wiser et al. | |
| 7,731,769 | B2 | 6/2010 | Min | |
| 7,815,720 | B2 | 10/2010 | McKinney | |
| 8,182,563 | B2 | 5/2012 | Horne et al. | |
| 2002/0134238 | A1 | 9/2002 | Conrad et al. | |
| 2003/0037676 | A1 | 2/2003 | Dunshee | |
| 2004/0065202 | A1 | 4/2004 | Gatchell et al. | |
| 2004/0177471 | A1 * | 9/2004 | Jung et al. | 15/352 |
| 2004/0194250 | A1 | 10/2004 | Conrad et al. | |
| 2005/0000361 | A1 | 1/2005 | Chang et al. | |
| 2005/0028675 | A1 | 2/2005 | Conrad et al. | |
| 2005/0050678 | A1 | 3/2005 | Oh et al. | |
| 2005/0087080 | A1 | 4/2005 | Yoshida et al. | |
| 2005/0091786 | A1 | 5/2005 | Wright et al. | |
| 2005/0125939 | A1 | 6/2005 | Hansen et al. | |
| 2005/0125940 | A1 * | 6/2005 | McDowell | 15/353 |
| 2005/0132529 | A1 * | 6/2005 | Davidshofer | 15/347 |
| 2005/0132886 | A1 | 6/2005 | Schultze et al. | |
| 2005/0177974 | A1 | 8/2005 | Conrad et al. | |
| 2006/0117520 | A1 * | 6/2006 | Choi | 15/352 |
| 2006/0123590 | A1 | 6/2006 | Fester et al. | |
| 2006/0151382 | A1 * | 7/2006 | Petrik | 210/490 |
| 2006/0168923 | A1 | 8/2006 | Lee et al. | |
| 2006/0278081 | A1 | 12/2006 | Han et al. | |
| 2007/0079587 | A1 * | 4/2007 | Kim | 55/349 |
| 2007/0199449 | A1 | 8/2007 | Wiser et al. | |
| 2007/0199451 | A1 | 8/2007 | Wiser | |
| 2008/0250926 | A1 | 10/2008 | Riskin | |
| 2010/0212104 | A1 | 8/2010 | Conrad | |
| 2010/0236012 | A1 | 9/2010 | Horne | |
| 2010/0242214 | A1 | 9/2010 | Sunderland et al. | |
| 2010/0242215 | A1 | 9/2010 | Dyson et al. | |
| 2010/0242216 | A1 | 9/2010 | MacNaughton | |
| 2010/0242217 | A1 | 9/2010 | Sunderland et al. | |
| 2010/0242218 | A1 | 9/2010 | Genn et al. | |
| 2010/0242219 | A1 | 9/2010 | Dyson et al. | |
| 2010/0242220 | A1 | 9/2010 | Dyson et al. | |
| 2010/0242221 | A1 | 9/2010 | Horne et al. | |
| 2011/0016659 | A1 | 1/2011 | Dyson et al. | |
| 2011/0016661 | A1 | 1/2011 | Dyson et al. | |
| 2011/0016662 | A1 | 1/2011 | Horne | |
| 2011/0016663 | A1 | 1/2011 | Horne | |

FOREIGN PATENT DOCUMENTS

| | | |
|---|---|---|
| CN | 1751648 | 3/2006 |
| CN | 1879542 | 12/2006 |
| CN | 201179381 | 1/2009 |
| DE | 38 04 651 | 8/1989 |
| EP | 0 042 723 | 12/1981 |
| EP | 0 299 197 | 1/1989 |
| EP | 0 443 254 | 8/1991 |
| EP | 0 815 788 | 1/1998 |
| EP | 1 239 760 | 9/2002 |
| EP | 1 688 078 | 8/2006 |
| EP | 1 733 795 | 12/2006 |
| FR | 2 859 372 | 3/2005 |
| FR | 2 884 857 | 10/2006 |
| GB | 2 033 256 | 5/1980 |
| GB | 2 349 105 | 10/2000 |
| GB | 2 365 324 | 2/2002 |
| GB | 2 384 451 | 7/2003 |
| GB | 2 418 163 | 3/2006 |
| GB | 2 435 626 | 9/2007 |
| JP | 43-10791 | 5/1968 |
| JP | 55-101758 | 8/1980 |
| JP | 56-53771 | 5/1981 |
| JP | 61-29856 | 2/1986 |
| JP | 7-39479 | 2/1995 |
| JP | 2000-515810 | 11/2000 |
| JP | 2003-517862 | 6/2003 |
| JP | 2004-510452 | 4/2004 |
| JP | 2005-21469 | 1/2005 |
| JP | 2005-307831 | 11/2005 |
| JP | 2006-136766 | 6/2006 |
| JP | 2006-205162 | 8/2006 |
| JP | 2006-346429 | 12/2006 |
| JP | 2007-167632 | 7/2007 |
| JP | 2007-252577 | 10/2007 |
| JP | 2007-296305 | 11/2007 |
| JP | 2008-272474 | 11/2008 |
| JP | 2009-11869 | 1/2009 |
| WO | WO-02/069777 | 9/2002 |
| WO | WO-02/069778 | 9/2002 |
| WO | WO-02/078506 | 10/2002 |
| WO | WO-2008/135708 | 11/2008 |

OTHER PUBLICATIONS

Horne, U.S. Office Action mailed Mar. 22, 2012, directed to U.S. Appl. No. 12/303,921; 8 pages.

Horne, L. et al., U.S. Office Action mailed Aug. 2, 2011, directed to U.S. Appl. No. 12/749,137; 9 pages.

European Search Report mailed Nov. 3, 2010, directed to counterpart application No. EP 10 17 0150; 5 pages.

Dyson et al., U.S. Office Action mailed Aug. 21, 2012, directed to U.S. Appl. No. 12/836,361; 7 pages.

Horne, U.S. Office Action mailed Dec. 19, 2012, directed to U.S. Appl. No. 12/837,262; 7 pages.

Horne, U.S. Office Action mailed Dec. 20, 2012, directed to U.S. Appl. No. 12/837,166; 7 pages.

Horne, U.S. Office Action mailed Apr. 12, 2013, directed to U.S. Appl. No. 12/837,166; 6 pages.

* cited by examiner

SEPARATING APPARATUS

REFERENCE TO RELATED APPLICATIONS

This application claims the priority of United Kingdom Application No 0912933.9, filed Jul. 24, 2009, the entire contents of which are incorporated herein by reference.

FIELD OF THE INVENTION

The present invention relates to a separating apparatus for separating particles from a fluid flow. Particularly, but not exclusively, the invention relates to a vacuum cleaner having such a separating apparatus for removing dust particles from a dust laden airstream.

BACKGROUND OF THE INVENTION

It is known to separate particles, such as dirt and dust particles, from a fluid flow using mechanical filters, such as mesh and foam filters, cyclonic separators and electrostatic separators.

Known separating apparatus include those used in vacuum cleaners, for example cyclonic separating apparatus. Such cyclonic separating apparatus are known to comprise a low efficiency cyclone for separating relatively large particles and a high efficiency cyclone located downstream of the low efficiency cyclone for separating the fine particles which remain entrained within the airflow (see, for example, EP 0 042 723B).

Known electrostatic filters used in vacuum cleaners include frictional electrostatic filters and electret medium filters. Examples of such filters are described in EP0815788, U.S. Pat. No. 7,179,314 and U.S. Pat. No. 6,482,252.

Such electrostatic filters are relatively cheap to produce but suffer from the disadvantage that their charge dissipates over time resulting in a reduction of their electrostatic properties. This in turn reduces the amount of dust the electrostatic filter can collect which may shorten the life of both the electrostatic filter itself and any further downstream filters.

Known electrostatic filters also include filters where dust particles in an airstream are charged in some way and then passed over or around a charged collector electrode for collection. An example of such an electrostatic filter is described in JP2007296305 where dust particles in an airstream are charged as they pass a "corona discharge" wire and are then trapped on a conductive filter medium located downstream of the corona discharge wire. A disadvantage with this arrangement is that they are relatively inefficient, are made from relatively expensive materials and the collector electrodes require constant maintenance in order to keep them free of collected dust. Once the collector electrodes are coated in a layer of dust they are much less efficient.

Another example of an electrostatic filter is shown in GB2418163 where the dust particles in an airstream are charged as they pass a corona discharge wire located inside a cyclone. The charged dust particles are then trapped on the walls of the cyclone which are coated in a conductive paint. While this arrangement is compact it suffers from the disadvantage that dust collects on the inside of the cyclones. Not only does this require constant and difficult maintenance removing dust from the walls of the cyclone, but also any dust trapped inside the cyclone will interfere with the cyclonic airflow decreasing the separation efficiency of the cyclone itself.

In vacuum cleaner applications, particularly in domestic vacuum cleaner applications, it is desirable for the appliance to be made as compact as possible without compromising on performance. It is also desirable for the dust separating efficiency to be as high as possible while maintaining suitable filter lifetime.

SUMMARY OF THE INVENTION

Accordingly, the present invention provides a separating apparatus comprising at least one cyclone, and an electrostatic filter in fluid communication with the at least one cyclone, wherein at least a portion of the electrostatic filter is located longitudinally through the separating apparatus.

Most preferably the present invention provides a separating apparatus comprising a first cyclonic cleaning stage comprising at least one cyclone, and an electrostatic filter located downstream of and in fluid communication with the at least one cyclone, wherein at least a portion of the electrostatic filter is located longitudinally through the separating apparatus, at least a portion of the first cyclonic cleaning stage being arranged around the electrostatic filter.

The arrangement of the invention makes use of the high separation efficiency and long filter life which has been found to be achievable using a combination of cyclonic dust separation and electrostatic dust separation. The arrangement of having an electrostatic filter located longitudinally through the separating apparatus has been found to result in a compact structure which may be very useful, for example in domestic vacuum cleaner applications. It may be advantageous to have the electrostatic filter located downstream of the first cyclonic cleaning stage because the electrostatic filter has been found to be more efficient at removing smaller rather than larger particles. The first cyclonic cleaning stage may therefore help the efficiency of the electrostatic filter by removing at least some of the larger particles which enter the separating apparatus during use.

In a preferred embodiment all or substantially all of the electrostatic filter is located longitudinally through the separating apparatus. Ideally the separating apparatus has a longitudinal axis and the longitudinal axis of the electrostatic filter is in line with the longitudinal axis of the separating apparatus. In a particular arrangement the electrostatic filter is arranged down the centre of the separating apparatus.

In a preferred embodiment the electrostatic filter is elongate in shape, for example being arranged such that in use a dust laden airstream will pass longitudinally along the length of the electrostatic filter. The electrostatic filter may be of any suitable shape in cross section, for example, round, square or triangular. In a particular embodiment the electrostatic filter may be cylindrical. The electrostatic filter may be of any suitable type for example it may be a frictional electrostatic filter, an electret media filter or it may be an electrostatic filter which is connected to a high voltage power supply.

In a preferred embodiment the first cyclonic cleaning stage comprises a single cylindrical cyclone and a dust collecting bin. The dust collecting bin may be formed from a lower section of the cylindrical cyclone itself or it may be in the form of a separate dust collecting bin removably attached to the base of the cylindrical cyclone.

The first cyclonic cleaning stage or a portion of it may be arranged around the electrostatic filter such that the electrostatic filter is partially or totally surrounded by the first cyclonic cleaning stage. Ideally the external surface of the electrostatic filter is not subject to the cyclonic airflow inside the first cyclonic cleaning stage. In other words the electrostatic filter is not located inside the first cyclonic cleaning stage but it is surrounded by it.

The separating appliance may also further comprise a second cyclonic cleaning stage arranged downstream from the first cyclonic cleaning stage. In a preferred embodiment the first cyclonic cleaning stage or at least a portion of it may be arranged around the second cyclonic cleaning stage or a portion of the second cyclonic cleaning stage, such that the second cyclonic cleaning stage or a portion of it is surrounded by the first cyclonic cleaning stage or a portion of it. In this embodiment the second cyclonic cleaning stage or a portion of it may therefore be located longitudinally through the first cyclonic cleaning stage. The first cyclonic cleaning stage may therefore be annular in shape.

In a particular embodiment the second cyclonic cleaning stage may comprise a plurality of secondary cyclones arranged in parallel and a dust collecting bin, which may be arranged below the secondary cyclones. In a preferred embodiment the secondary cyclones may be formed in a ring above or at least partially above the first cyclonic cleaning stage. Ideally the secondary cyclones are centered about the longitudinal axis of the first cyclonic cleaning stage.

In a preferred embodiment the dust collecting bin of the second cyclonic cleaning stage may be arranged longitudinally through the separating apparatus such that it is surrounded by the first cyclonic cleaning stage. In such an embodiment the first cyclonic cleaning stage may be annular in shape.

In a preferred embodiment the electrostatic filter may be located longitudinally through the centre of the second cyclonic cleaning stage. In such an embodiment the dust collecting bin of the second cyclonic cleaning stage may also be annular in shape. In such an embodiment the first cyclonic cleaning stage, the second cyclonic cleaning stage and the electrostatic filter may be arranged concentrically. Preferably they are arranged about a common central axis of the separating apparatus. Preferably the secondary cyclones surround a top portion of the electrostatic filter and the dust collecting bin of the second cyclonic cleaning stage surrounds a lower portion of the electrostatic filter.

In a preferred embodiment the electrostatic filter is separate from, but in fluid communication with, the first and/or second cyclonic cleaning stages. The term "separate from" as used herein shall be taken to mean that the electrostatic filter is not located physically within the first cyclonic cleaning stage or the second cyclonic cleaning stage i.e. the electrostatic filter is not subjected to the cyclonic airflow set up inside the cyclonic cleaning stages during use.

The electrostatic filter may be located between the first and second cyclonic cleaning stages or downstream of the second cyclonic cleaning stage. In a particularly preferred embodiment the electrostatic filter may be located downstream of the second cyclonic cleaning stage.

This arrangement is particularly advantageous because as stated earlier electrostatic filters have been found to be more efficient when challenged with small dust particles, for example dust particles smaller than 1 micron. Placing the electrostatic filter downstream of the second cyclonic cleaning stage therefore ensures that the electrostatic filter is only challenged with the very small particles which have managed to pass through the first and second cyclonic cleaning stages. In addition, as dust particles pass through the first and second cyclonic cleaning stages during use, they become charged due to friction with the walls of the cyclonic cleaning stages. This pre charging of the dust particles also helps to improve the dust collecting efficiency of the electrostatic filter.

The electrostatic filter may be directly downstream of the second cyclonic cleaning stage or it may be in fluid communication with the second cyclonic cleaning stage via an air passage.

In a preferred embodiment at least a portion of an air passage may be formed longitudinally through the separating apparatus. In a preferred embodiment the air passage may be surrounded by the electrostatic filter and the electrostatic filter may be surrounded by the dust collection bin and/or the secondary cyclones of the second cyclonic cleaning stage. In such an embodiment the electrostatic filter may be annular in shape. In a most preferred embodiment the electrostatic filter may surround the air passage, the dust collection bin of the second cyclonic cleaning stage surrounds a lower portion of the electrostatic filter, the secondary cyclones surround an upper portion of the electrostatic filter and the first cyclonic cleaning stage surrounds the dust collection bin of the second cyclonic cleaning stage.

In an alternative embodiment the air passage may be arranged around the electrostatic filter. In such an embodiment the air passage may be annular and may be located between the electrostatic filter and the second cyclonic cleaning stage.

The electrostatic filter may be in direct fluid communication with an exit port of the separating apparatus or it may be in fluid communication with the exit port via an exit passage located downstream of the electrostatic filter. The exit port may be located on an upper or lower end of the cyclonic separating apparatus.

In a particular embodiment at least a portion of the exit passage may be formed longitudinally through the separating apparatus. The air passage may surround the electrostatic filter and may be annular in shape. In such an embodiment at least a portion of the exit passage may be surrounded by the second cyclonic cleaning stage.

In an alternative embodiment at least a portion of the exit passage may be formed longitudinally through the separating apparatus such that at least a portion of it is surrounded by the air passage and/or the electrostatic filter and/or the second cyclonic cleaning stage.

In a particular embodiment the electrostatic filter may extend from a top edge of the second cyclonic cleaning stage to at or near a base of the separating apparatus. Preferably the electrostatic filter may extend along 40, or 45, or 50, or 55, or 60, or 65, or 70, or 75, to 80, or 85, or 90, or 95, or 100 percent of the distance between the top edge of the second cyclonic cleaning stage and the base of the separating apparatus. Alternatively or additionally the electrostatic filter may extend from 50, or 55, or 60, or 65, or 70, to 75, or 80, or 85, or 90, or 95, or 100 percent of the length of the separating apparatus.

As stated above the electrostatic filter may be any type of electrostatic filter but preferably it comprises a filter medium located between a first and a second electrode each at a different voltage during use such that a potential difference is formed across the filter medium. The first and second electrodes preferably form at least a portion of an air pathway in which the filter medium is located, such than in use air flows through the filter medium.

In a preferred embodiment the electrodes may be non-porous. Preferably the filter medium has a length and the first and second electrodes are non-porous along the length of the filter medium. In a most preferred embodiment the first and second electrodes are non-porous along their entire length.

As used herein the term "non-porous" shall be taken to mean that the first and second electrodes have continuous solid surfaces without perforations, apertures or gaps. In a preferred embodiment the first and second electrodes are non-porous such that during use an airflow travels along the length of the electrodes through the filter medium. Ideally the airflow does not pass through the first or second electrodes.

Such an arrangement where the air does not have to flow through the electrodes during use may be advantageous because it may reduce the pressure drop across the electrostatic filter. In addition because the electrodes are non-porous they have a larger surface area than they would if the electrodes were porous. This may improve the overall performance of the electrostatic filter.

In a preferred embodiment the filter medium may be an electrically resistive filter medium. As used herein the term "electrically resistive filter medium" shall be taken to mean that the filter medium has a resistivity of from $1\times10^{7}$ to $1\times10^{13}$ ohm-meters at 22° C. In a most preferred embodiment the filter medium may have a resistivity of from $2\times10^{9}$ to $2\times10^{11}$ ohm-meters at 22° C. The electrical resistivity of the filter medium may vary along the length of the filter medium. In a particular embodiment the electrical resistivity may decrease in a downstream direction.

This electrostatic filter uses the potential difference formed across the filter medium to collect dust in the filter medium itself rather than on collector electrodes. This arrangement is advantageous over previous electrostatic filters because there are no collector electrodes to clean. This may reduce the need for maintenance and increase the life of the filter due to the dust retention capacity of the filter medium.

The potential difference occurs because the electrically resistive filter medium provides a load and therefore only a small current flows through it. However the electric field will disturb the distribution of any positive and negative charges, in the fibers of the electrically resistive filter medium, causing them to align with their respective electrode. This process causes the dust to bond to or settle on the fibers of the filter medium because dust particles in an airstream passing through the filter will be attracted to respective positive and negative ends of the filter medium. This may help to cause the dust particles to be trapped in the filter medium itself without requiring the dust particles to be captured on a charged electrode.

The electrostatic filter may also further comprise at least one corona discharge means. Preferably the filter medium may be arranged downstream of the corona discharge means. Adding a corona discharge means advantageously may increase the efficiency of the electrostatic filter. This is because the corona discharge means helps to charge any dust particles in the airstream before they pass through the filter medium thus helping to increase dust particle attraction to the filter medium.

In a preferred embodiment the corona discharge means may comprise at least one corona discharge electrode of high curvature and at least one electrode of low curvature. This arrangement may be advantageous as it may generate a large source of ions for charging any dust particles in the airstream. These charged dust particles are then more likely to be filtered out by the filter medium which has the potential difference across it during use.

The electrode of low curvature may be a flat or a curved surface. The corona discharge electrode may be in any suitable form as long as it is of a higher curvature than the electrode of low curvature. In other words the corona discharge electrode is preferably of a shape which causes the electric filed at its surface to be greater than the electric field at the surface of the electrode of low curvature. Examples of suitable arrangements would be where the corona discharge electrode is one or more wires, points, needles or serrations and the electrode of low curvature is a tube which surrounds them. Alternatively the electrode of low curvature may be a flat plate.

In a particular embodiment the corona discharge electrode may be formed from a portion of the first or second electrode. In a preferred embodiment the corona discharge electrode is in the form of one or more points formed from or on a lower or upper edge of the first or second electrode. Ideally the lower or upper edge of the second electrode is serrated to form the corona discharge electrode.

The electrode of low curvature may also be formed from a portion of the first or second electrode. In a particular embodiment the upper or lower edge of the second electrode is serrated to form the corona discharge electrode and a corresponding upper or lower portion of the first electrode forms the electrode of low curvature. The position of the electrode of low curvature and/or the corona discharge electrode depends on the orientation of the electrostatic filter and the direction in which air enters it during use. For example, if the electrostatic filter is arranged such that air enters from an upper end then the electrode of low curvature and the corona discharge electrode are preferably located on an upper portion of the first and second electrode. Alternatively, if the electrostatic filter is arranged such that air enters from a lower end then the electrode of low curvature and the corona discharge electrode are preferably located on a lower portion of the first and second electrode.

This arrangement is advantageous as there is no requirement for separate components forming the corona discharge electrode or the electrode of low curvature.

In a preferred embodiment the electrode of low curvature projects both upstream and downstream from a lower or upper surface of the corona discharge electrode. This may help to maximize the volume over which the ionizing field is generated thus maximizing the opportunity for charging dust particles as they pass through the ionizing field.

In an alternative embodiment the corona discharge electrode may be remote from the first and second electrodes. In such an embodiment the corona discharge electrode may be in the form of one or more wires, needles, points or serrations. In such an embodiment the electrode of low curvature may still be formed from a portion of the first or second electrode. In a particular embodiment a portion of the second electrode may form the electrode of low curvature. In a preferred embodiment the electrode of low curvature and the corona discharge electrode are arranged to maximize the volume over which the ionizing field is generated to maximize the opportunity for charging dust particles as they pass through the ionizing field.

In another alternative embodiment both the corona discharge electrode and the electrode of low curvature may be located remotely from the first and second electrodes.

The first and second electrodes may be of any suitable shape, for example they may be planar and the filter medium may be sandwiched between the layers. Such planar layers may be of any suitable shape for example square, rectangular, circular or triangular. In a particular embodiment the separating apparatus may comprise a plurality of first and second electrodes arranged in parallel. In such an embodiment filter medium is preferably located between adjacent electrodes and the adjacent electrodes are at a different voltage during use such that a potential difference is formed across the filter medium. The first and second electrodes may be arranged inside a tubular passageway which forms an outer surface of the electrostatic filter. In such an embodiment the electrodes are preferably arranged longitudinally down the tubular passageway. Such an arrangement provides a plurality of parallel air passages running longitudinally through the electrostatic filter. Preferably the tubular passageway is non-electrically conductive, i.e. electrically resistive/an insulator.

In such an embodiment the first electrodes and the second electrodes are preferably at different voltages during use. All of the first electrodes are preferably at the same voltage and all of the second electrodes are preferably at the same voltage. The first electrodes may have either a higher or a lower voltage than the second electrodes. In a particularly preferred embodiment the first electrodes may be at 0 Volts or +/−2 kV and the second electrodes may be at from +/−2, or 4, or 5, or 6, or 7, or 8, or 9, or 10 to 11, or 12, or 13, or 14, or 15 kV. In a most preferred embodiment the second electrodes may be at from −2 or −4 to −10 kV. The electrodes may be regularly spaced apart inside the tubular passageway, for example the first and second electrodes may be arranged from 1 mm, or 3 mm, or 5 mm, or 7 mm to 9 mm, or 10 mm, or 12 mm, or 15 mm, or 20 mm apart.

In an alternative embodiment the first and/or the second electrodes may be tubular, for example they may be cylindrical with the filter medium located between the electrode tubes. In a preferred embodiment the first and second electrodes may be located concentrically with the filter medium located concentrically between them. Preferably the second electrode is located concentrically inside the first electrode and therefore has a smaller diameter than the first electrode. In a particular embodiment a surface of the second electrode or a wall surrounding or supporting the second electrode may form a wall of the air passage.

The electrostatic filter may also further comprise a third electrode. In such an embodiment the second electrode may be located between the first and the third electrodes. The third electrode may also be of any suitable shape but is preferably cylindrical and in such an embodiment the second electrode may preferably be concentrically located between the first electrode and the third electrode. In such an embodiment a further filter medium may be located between the second electrode and the third electrode. Preferably the third electrode is located concentrically inside the second electrode and therefore has a smaller diameter than the second electrode. Again this arrangement is advantageous as it allows for a very compact structure. In this embodiment a surface of the third electrode or a wall surrounding or supporting the third electrode may form a wall of the air passage. Such an arrangement provides a plurality of annular air passages through running longitudinally through the electrostatic filter.

Again the second electrode and the third electrode are preferably each at a different voltage during use such that a potential difference is formed across the further filter medium.

In such an embodiment the first electrode and the third electrode may be at the same voltage during use. The second electrode may be either positively or negatively charged. Ideally the second electrode is negatively charged. The first electrode and the third electrode may have either a higher or a lower voltage than the second electrode. In a preferred embodiment the first electrode and the third electrode may have a higher voltage than the second electrode. In a particularly preferred embodiment the first electrode and the third electrode may be at +/−2 kV or 0 Volts and the second electrode may be at from +/−2, or 4, or 5, or 6, or 7, or 8, or 9, or 10 to 11, or 12, or 13, or 14, or 15 kV. In a most preferred embodiment the second electrode may be at from −2 or −4 to −10 kV. The electrodes may be regularly spaced, for example the first, second and third electrodes may be arranged from 1 mm, or 3 mm, or 5 mm, or 7 mm to 9 mm, or 10 mm, or 12 mm, or 15 mm, or 20 mm, or 40 mm apart.

The electrodes described above in relation to all of the embodiments may be formed from any suitable conductive material. Preferably, the first and/or second and/or third electrodes are formed from a conductive metal sheet, foil or coating of from 2 microns, or 10 microns, or 50 microns or 0.1 mm, or 0.25 mm, or 0.5 mm, or 1 mm, or 1.5 mm, or 2 mm to 2.5 mm, or 3 mm, or 4 mm in thickness. Additionally or alternatively the filter medium may be coated with one or more of the electrodes. For example one or more surfaces of the filter medium may be coated with a conductive material.

The filter medium may be of any suitable material for example glass, polyester, polypropylene, polyurethane or any other suitable plastics material. In a preferred embodiment the filter medium is an open cell reticulated foam, for example a polyurethane foam. Reticulated foams are formed when the cell windows within the foam are removed to create a completely open cell network. This type of filter medium is particularly advantageous as the foam may hold its structure in an airflow. The polyurethane foam may be derived from either polyester or polyether.

The pore size/diameter, PPI or type of filter medium may vary along the length of the filter medium. For example the pore size may decrease or increase in a downstream direction. As used herein the terms "pore size" and "pore diameter" are interchangeable. A method for measuring the average pore size/diameter and calculating the pores per inch is given in the specific description.

Such a change in pore size may be a gradual change which occurs in a single filter medium or a plurality of sections of filter medium may be brought together to form a filter medium which has a varying pore size across it's length. The PPI may also decrease or increase in a downstream direction, or alternatively it may vary in another random or non-random way.

The filter medium or a section of it may have 3, or 5, or 6, or, 8 or, 10, or 15, or 20, or 25, or 30 to 35, or 40, or 45, or 50, or 55, or 60 pores per inch (PPI) with an average pore diameter of from 0.4, or 0.5, or 1, or 1.5, or 2, or 2.5, or 3, or 3.5 to 4, or 4.5, or 5, or 5.5, or 6, or 6.5, or 7, or 7.5, or 8, 8.5 mm (or 400 microns to 8500 microns). In a preferred embodiment the filter medium or a section of it may have from 8 to 30 PPI with an average pore diameter of from 1.5 mm to 5 mm. In another preferred embodiment the filter medium or a section of it may have from 3 to 30 PPI with an average pore diameter of from 1.5 mm to 8 mm. Most preferably the PPI may be from 3 to 10 PPI. In a preferred embodiment an upstream portion/section of the filter medium may have a PPI of 3 PPI and a downstream portion/section may have a PPI of 6 PPI. In a preferred embodiment an upstream portion/section of the filter medium may have an average pore diameter of 7200 microns (7.2 mm) and a downstream portion/section may have an average pore diameter of 4500 microns (4.5 mm).

Preferably the separating apparatus forms part of a surface treating appliance, for example a vacuum cleaner. In a preferred embodiment the separating apparatus may be removably mounted on a main body of the surface treating appliance.

BRIEF DESCRIPTION OF THE DRAWINGS

The invention will now be described, by way of example, with reference to the accompanying drawings, in which.

Like reference numerals refer to like parts throughout the specification.

DETAILED DESCRIPTION OF THE INVENTION

Figure 1:
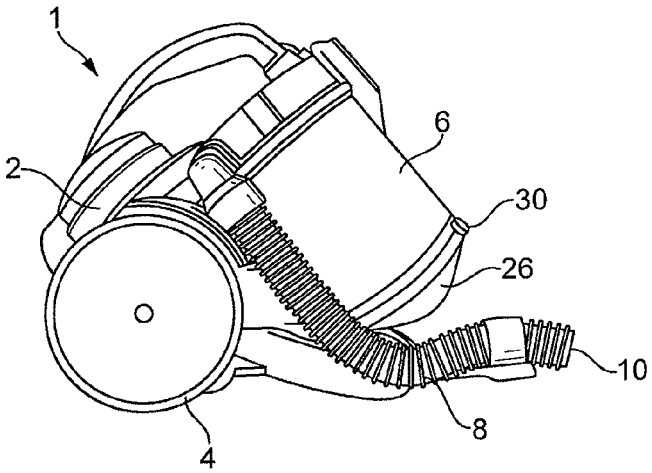
FIG. 1 is a canister vacuum cleaner incorporating a separating apparatus according to the present invention.
Figure 2:
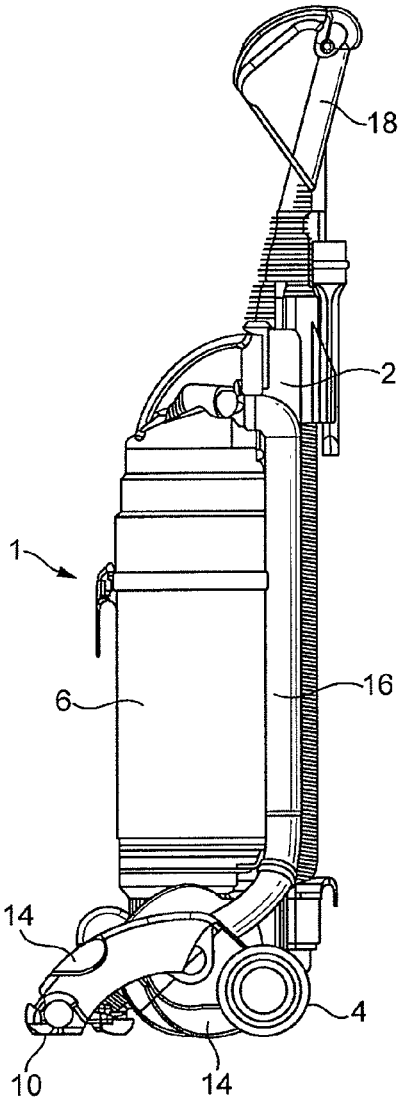
FIG. 2 is an upright vacuum cleaner incorporating a separating apparatus according to the present invention.

With reference to FIGS. 1 and 2 a vacuum cleaner is shown and indicated generally by the reference numeral 1.

In FIG. 1 the vacuum cleaner 1 comprises a main body 2, wheels 4 mounted on the main body 2 for maneuvering the vacuum cleaner 1 across a surface to be cleaned, and a separating apparatus 6 removably mounted on the main body 2. A hose 8 communicates with the separating apparatus 6 and a motor and fan unit (not shown) is housed within the main body 2 for drawing dust laden air into the separating apparatus 6 via the hose 8. Commonly, a floor-engaging cleaner head (not shown) is coupled to the distal end of the hose 8 via a wand to facilitate manipulation of a dirty air inlet 10 over the surface to be cleaned.

In use, dust laden air drawn into the separating apparatus 6 via the hose 8 has the dust particles separated from it in the separating apparatus 6. The dirt and dust is collected within the separating apparatus 6 while the cleaned air is channeled past the motor for cooling purposes before being ejected from the vacuum cleaner 1.

The upright vacuum cleaner 1 shown in FIG. 2 has a main body 2 in which a motor and fan unit (not shown) is mounted and on which wheels 4 are mounted to allow the vacuum cleaner 1 to be maneuvered across a surface to be cleaned. A cleaner head 14 is pivotably mounted on the lower end of the main body 2 and a dirty air inlet 10 is provided on the underside of the cleaner head 14 facing the surface to be cleaned. A separating apparatus 6 is removably provided on the main body 2 and ducting 16 provides communication between the dirty air inlet 10 and the separating apparatus 6. A wand and handle assembly 18 is releasably mounted on the main body 2 behind the separating apparatus 6.

In use, the motor and fan unit draws dust laden air into the vacuum cleaner 1 via either the dirty air inlet 10 or the wand 18. The dust laden air is carried to the separating apparatus 6 via the ducting 16 and the entrained dust particles are separated from the air and retained in the separating apparatus 6. The cleaned air is passed across the motor for cooling purposes and then ejected from the vacuum cleaner 1.

The separating apparatus 6 forming part of each of the vacuum cleaners 1 is shown in more detail in FIGS. 3*a*, 3*b*, 5, 6*a*, 6*b* and 7. The specific overall shape of the separating apparatus 6 can be varied according to the type of vacuum cleaner 1 in which the separating apparatus 6 is to be used. For example, the overall length of the separating apparatus 6 can be increased or decreased with respect to the diameter of the separating apparatus 6.

Figure 4:
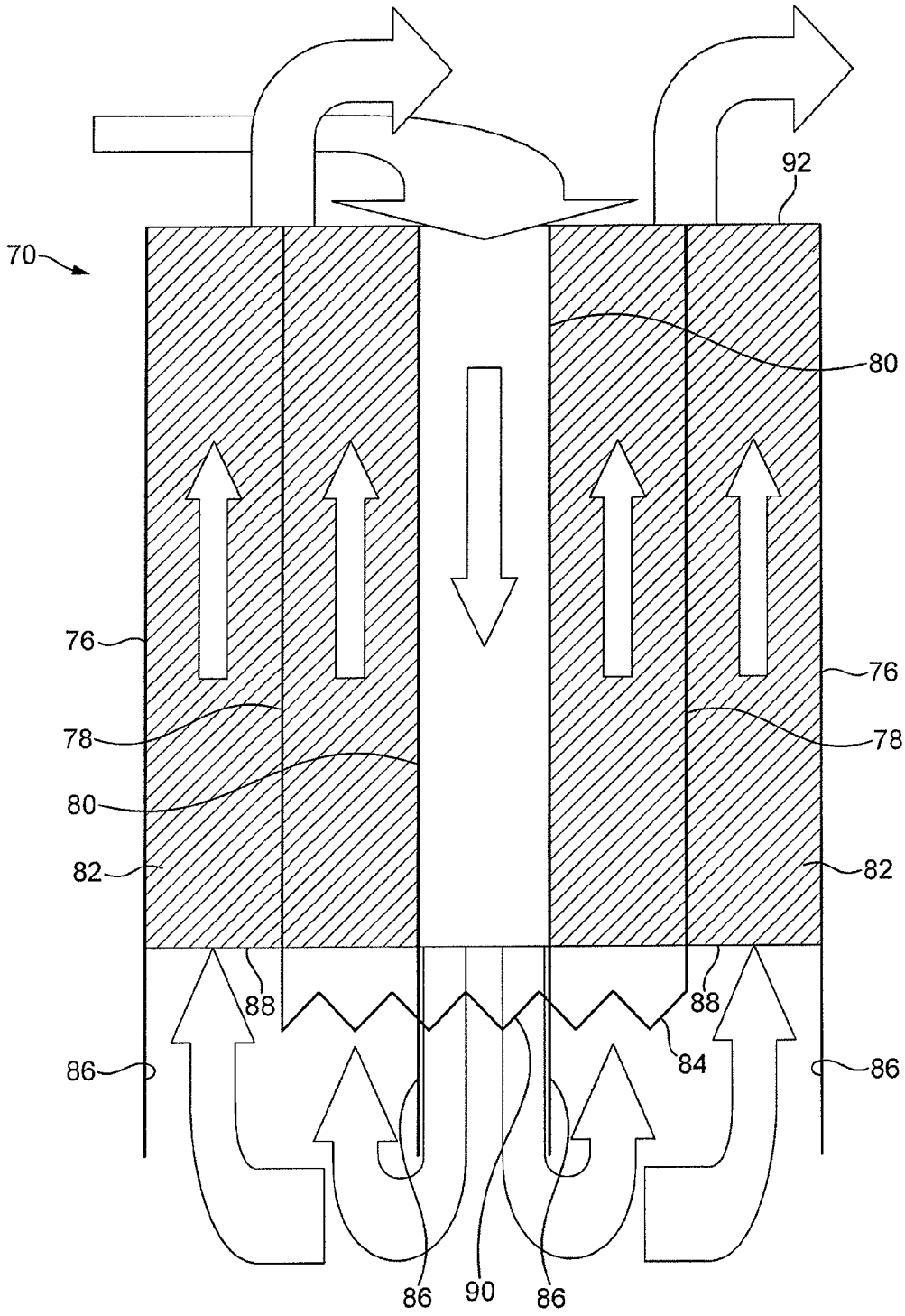
FIG. 4 is a schematic section through the electrostatic filter shown in FIG. 3.

The separating apparatus 6 comprises a first cyclonic cleaning stage 20, a second cyclonic cleaning stage 22 and an electrostatic filter 70 located longitudinally through the separating apparatus 6. An embodiment of the electrostatic filter can be seen in more detail in FIG. 4.

The first cyclonic cleaning stage 20 can be seen to be the annular chamber 38 located between the outer wall 24 which is substantially cylindrical in shape and the second cylindrical wall 36 which is located radially inwardly from the outer wall 24 and spaced from it. The lower end of the first cyclonic cleaning stage 20 is closed by a base 26 which is pivotably attached to the outer wall 24 by means of a pivot 28 and held in a closed position by a catch 30. In the closed position, the base 26 is sealed against the lower ends of the walls 24, 36. Releasing the catch 30 allows the base 26 to pivot away from the outer wall 24 and the second cylindrical wall 36 for emptying the first cyclonic cleaning stage 20 and the second cyclonic cleaning stage 22

In this embodiment the top portion of the annular chamber 38 forms a cylindrical cyclone 32 of the first cyclonic cleaning stage 22 and the lower portion forms a dust collecting bin 34. The second cyclonic cleaning stage 22 comprises 12 secondary cyclones 50 which are arranged in parallel and a second dust collecting bin 64.

A dust laden air inlet 40 is provided in the outer wall 24 of the first stage cyclone 20. The dust laden air inlet 40 is arranged tangentially to the outer wall 24 so as to ensure that incoming dust laden air is forced to follow a helical path around the annular chamber 38. A fluid outlet from the first cyclonic cleaning stage 20 is provided in the form of a shroud 42. The shroud 42 comprises a cylindrical wall 44 in which a large number of perforations 46 are formed. The only fluid outlet from the first cyclonic cleaning stage 20 is formed by the perforations 46 in the shroud 42.

A passageway 48 is formed downstream of the shroud 42. The passageway 48 communicates with the second cyclonic cleaning stage 22. The passageway 48 may be in the form of an annular chamber which leads to inlets 52 of the secondary cyclones 50 or may be in the form of a plurality of distinct air passageways each of which leads to a separate secondary cyclone 50.

A third cylindrical wall 54 extends downwardly from a vortex finder plate 56 which forms a top surface of each of the secondary cyclones 50, towards the base 26. The third cylindrical wall 54 is located radially inwardly of the second cylindrical wall 36 and is spaced from it so as to form a second annular chamber 58 between them.

Figure 3A:
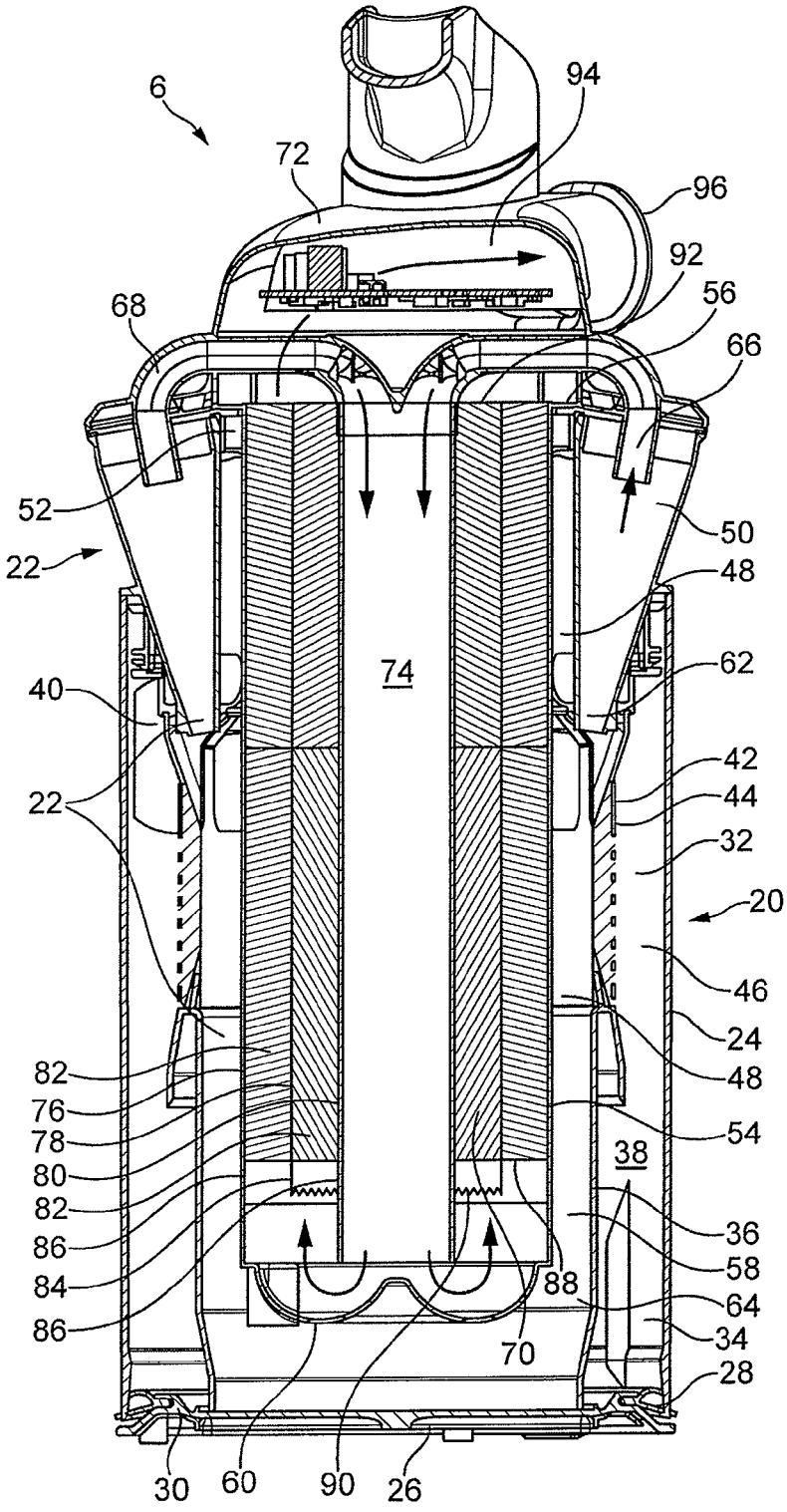
FIG. 3*a* is a longitudinal section through the separating apparatus shown in FIGS. 1 and 2.
Figure 5:
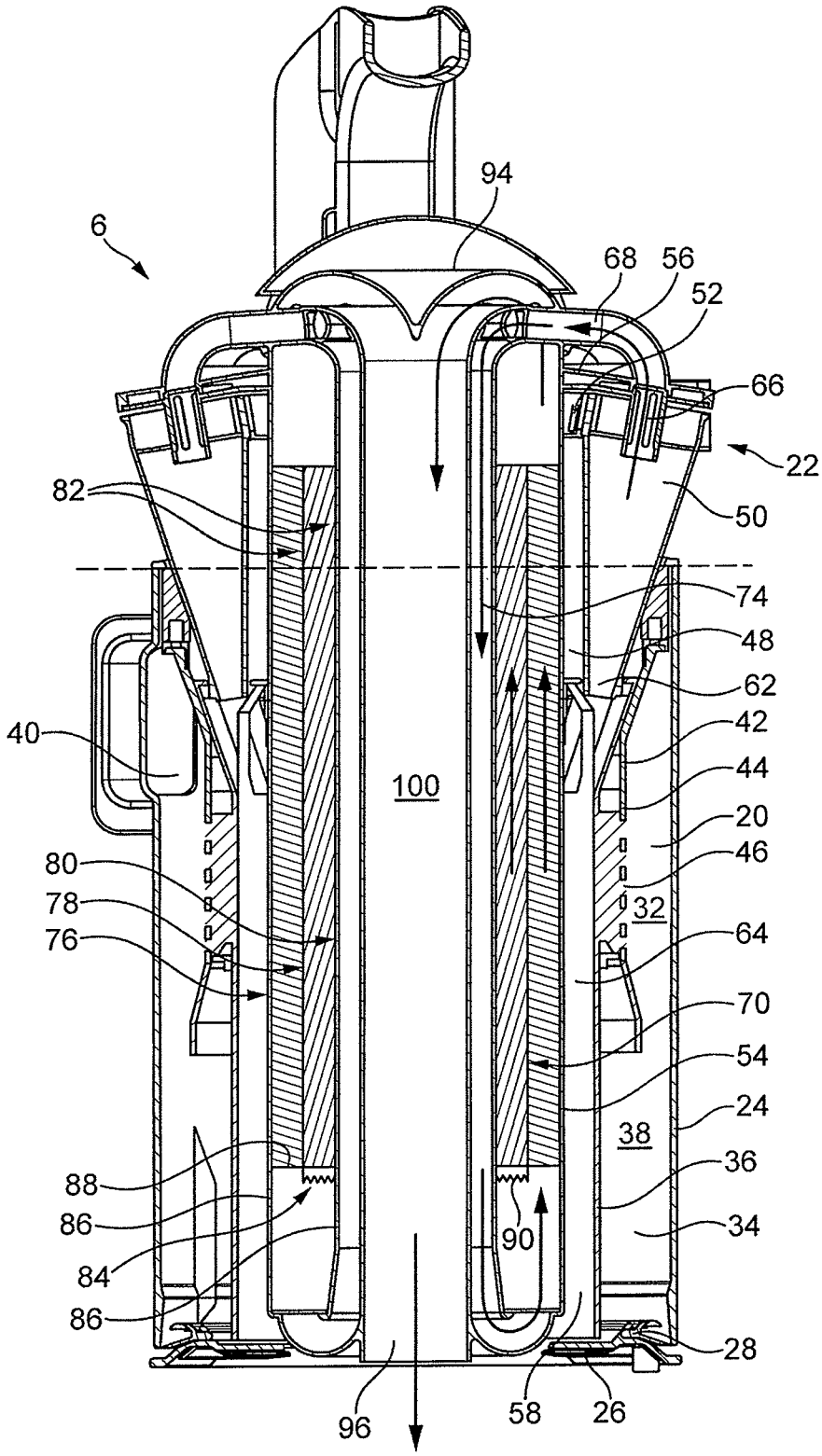
FIG. 5 is a section through an alternative embodiment of a separating apparatus.
Figure 6A:
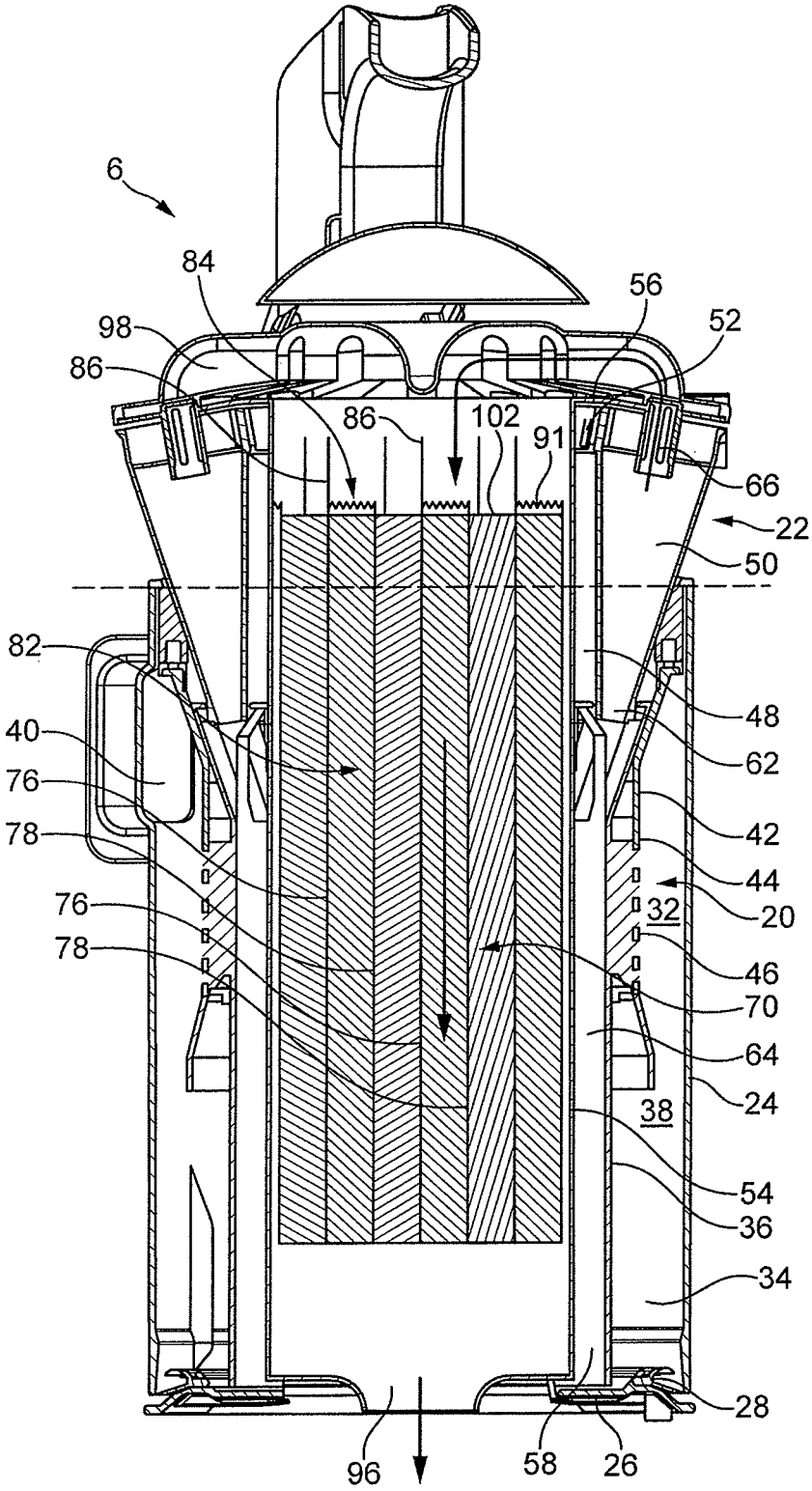
FIG. 6*a* is a longitudinal section through an alternative embodiment of a separating apparatus.
Figure 7:
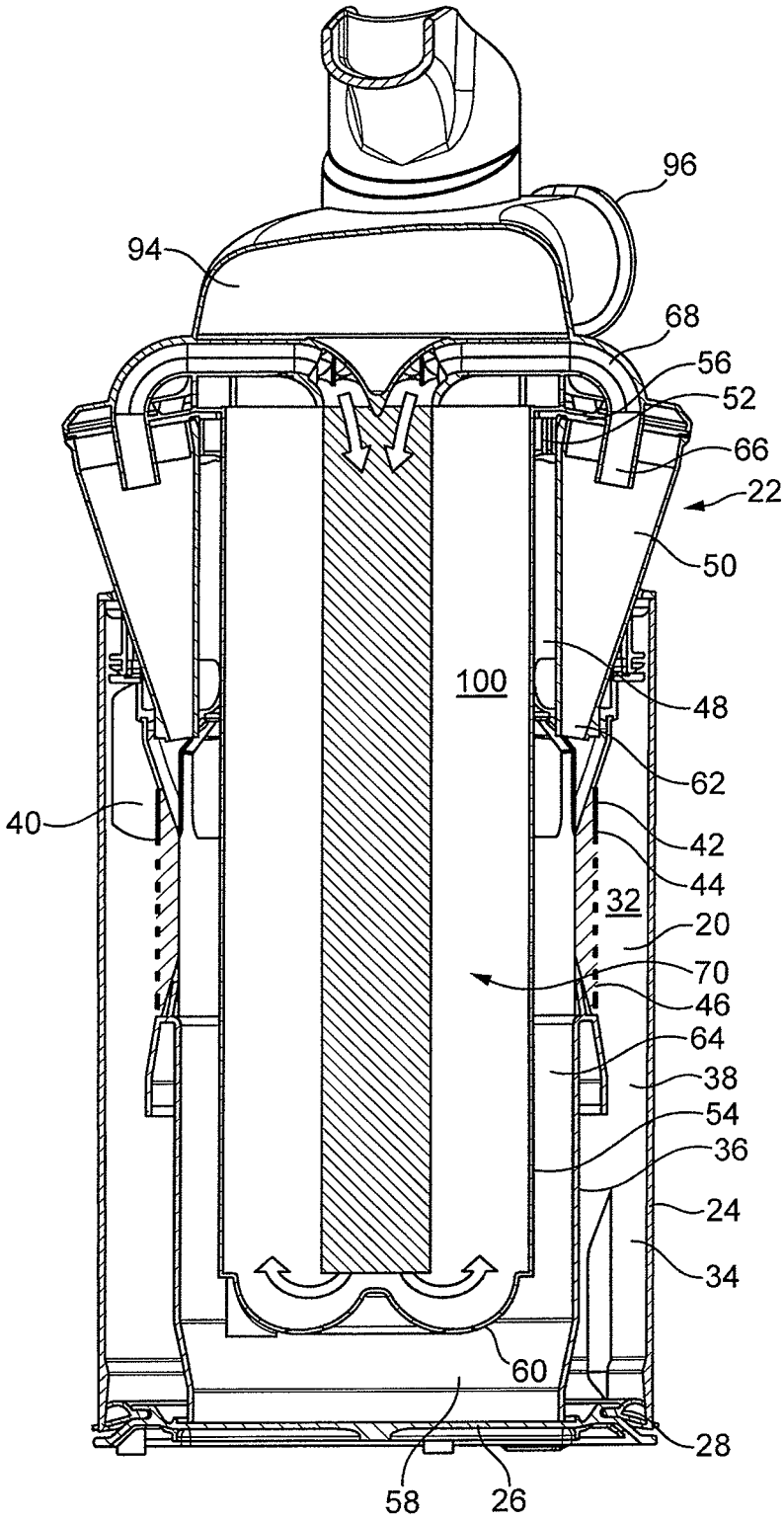
FIG. 7 is a section through an alternative embodiment of a separating apparatus.

When the base 26 is in the closed position, the third cylindrical wall 54 may reach down to and be sealed against the base 26 as shown in FIGS. 5 and 6*a*. Alternatively as shown in FIGS. 3*a* and 7 the third cylindrical wall 54 may stop short of the base 26 and may be sealed by an electrostatic filter base plate 60.

The secondary cyclones 50 are arranged in a circle substantially or totally above the first cyclonic cleaning stage 20. A portion of the secondary cyclones 50 may project into the top of the first cyclonic cleaning stage 20. The secondary cyclones 50 are arranged in a ring which is centred on the axis of the first cyclonic cleaning stage 20. Each secondary cyclone 50 has an axis which is inclined downwardly and towards the axis of the first cyclonic cleaning stage 20.

Each secondary cyclone 50 is frustoconical in shape and comprises a cone opening 62 which opens into the top of the second annular chamber 58. In use dust separated by the secondary cyclones 50 will exit through the cone openings 62 and will be collected in the second annular chamber 58. The second annular chamber 58 thus forms the dust collecting bin 64 of the second cyclonic cleaning stage 22. A vortex finder 66 is provided at the upper end of each secondary cyclone 50.

The vortex finders 66 may be an integral part of the vortex finder plate 56 or they may pass through the vortex finder plate 56. In all of the embodiments shown the vortex finders fluidly connect with the electrostatic filter 70.

In the embodiments shown in FIGS. 3*a*, 5 and 7 the vortex finders 66 lead into vortex fingers 68 which in FIGS. 3*a* and 5 communicate with an air passage 74 which leads to the lower end of the electrostatic filter 70 and in FIG. 7 communicates directly with the top end of the electrostatic filter 70. It is however possible that the vortex finders 66 could communicate with a plenum or manifold 98 which in turn communicates with an air passage or directly with the electrostatic filter 70. In FIG. 6*a* it can be seen that the vortex finders 66 communicate with a plenum 98 which communicates directly with the top end of the electrostatic filter 70.

Figure 3B:
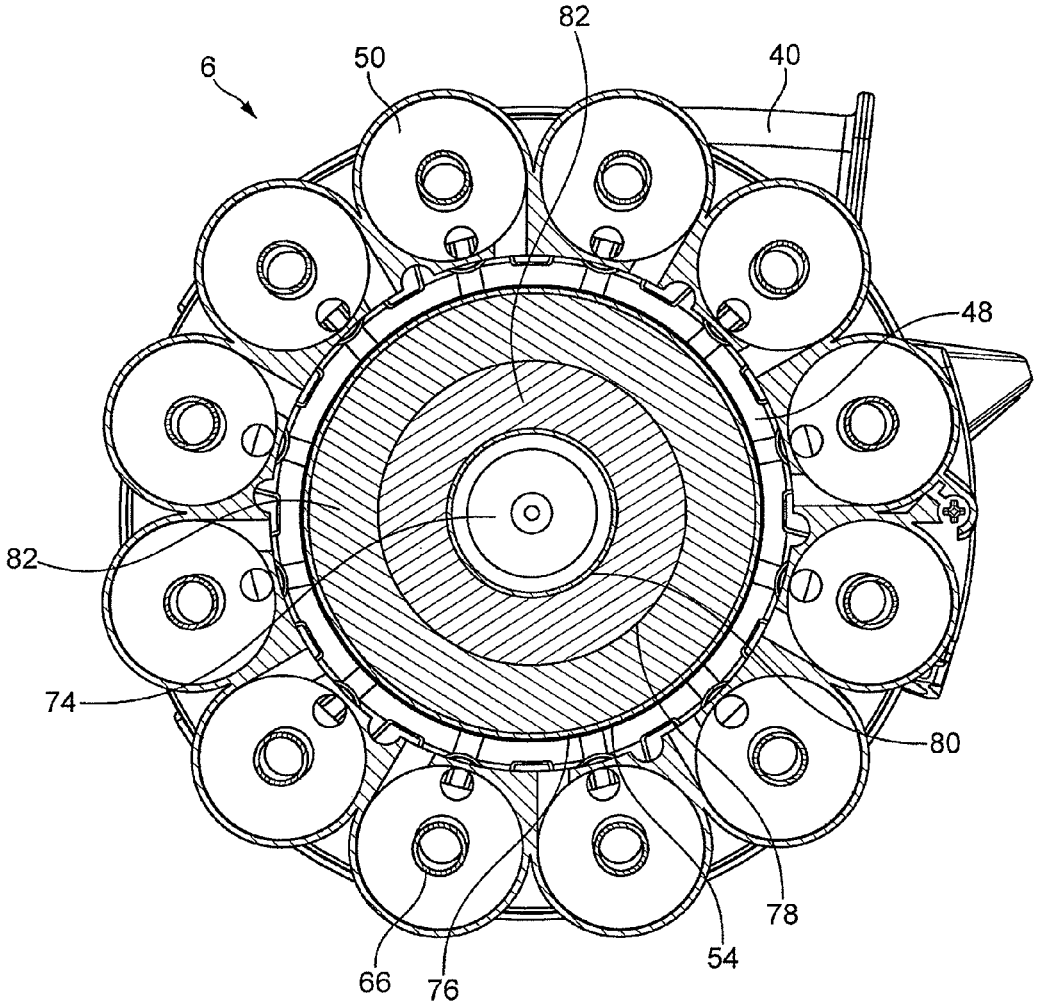
FIG. 3*b* is a horizontal section through the separating apparatus shown in FIGS. 1 and 2.

In FIGS. 3*a* and 3*b* it can be seen that the air passage 74 is arranged longitudinally down the centre of the separating apparatus 6. The electrostatic filter 70 is arranged around the air passage 74 such that the air passage 74 is partially or totally surrounded by the electrostatic filter 70. An upper end of the electrostatic filter 70 is fluidly connected to the exit port 96 of the separating apparatus 6 via the exhaust manifold 94. The exhaust manifold 94 at least partially surrounds the vortex fingers 68 to form an exhaust manifold containing two fluidly distinct air passages, the first being the exhaust manifold 94 itself and the second being the vortex fingers 68.

In FIG. 5 it can be seen that the air passage 74 is annular in shape and is at least partially surrounded by the electrostatic filter 70. The air passage 74 is arranged to provide a fluid passageway, or individual fluid passageways to the lower end of the electrostatic filter 70. An exhaust passage 100 provides a fluid passageway between the upper end of the electrostatic filter 70 and the exit port 96 which is located on a lower end of the separating apparatus 6. The exhaust passage 100 is arranged longitudinally down the centre of the separating apparatus 6. The air passage 74 is arranged around the exhaust passage 100 such that the exhaust passage 100 is partially or totally surrounded by the air passage 74.

In FIG. 6*a* it can be seen that the plenum 98 fluidly connects the vortex finders 66 and the electrostatic filter 70. A lower end of the electrostatic filter 70 is fluidly connected to the exit port 96 of the separating apparatus 6 which is located at a lower end of the separating apparatus 6. In this embodiment there is no air passage or exhaust passage.

In FIG. 7 it can be seen that the vortex fingers 68 lead directly to the electrostatic filter 70. An annular exhaust passage 100 is arranged around the electrostatic filter 70 such that the electrostatic filter 70 is arranged longitudinally down the centre of the separating apparatus 6 and is partially or totally surrounded by the annular exhaust passage 100. An upper end of the annular exhaust passage 100 is fluidly connected to the exit port 96 of the separating apparatus 6 via the exhaust manifold 94 located at an upper end of the separating apparatus 6. Again the exhaust manifold 94 at least partially surrounds the vortex fingers 68 to form an exhaust manifold 94 containing two fluidly distinct air passages, the first being the exhaust manifold 94 itself and the second being the vortex fingers 68.

In the embodiments described above the electrostatic filter 70 is arranged longitudinally down the separating apparatus 6 such that the secondary cyclones 50 and at least a portion of the dust collecting bin 64 surround the electrostatic filter 70. It can be seen that the secondary cyclones 50 surround a top portion of the electrostatic filter 70 and the dust collecting bin 64 surrounds a lower portion of the electrostatic filter 70. It can also be seen that the electrostatic filter 70 extends from the vortex finder plate 56 to near the base 26.

In the embodiment shown in FIGS. 3*a*, 3*b*, 4 and 5 the electrostatic filter 70 comprises concentrically arranged cylindrical first, second and third electrodes 76, 78, 80. A filter medium 82 is located between both the first and second electrodes 76, 78 and the second and third electrodes 78, 80.

The electrostatic filter 70 also comprises a corona discharge means in the form of a corona discharge electrode 84 and two electrodes of low curvature 86. The electrostatic filter 70 would however function without the corona discharge means.

The first electrode of low curvature 86 is an extension of the first electrode 76 below a lower surface 88 of the filter medium 82 and the second electrode of low curvature 86 is an extension of the third electrode 80 below the lower surface 88 of the filter medium 82.

The corona discharge electrode 84 is in the form of a serrated lower edge 90 of the second electrode 78 which extends below the lower surface 88 of the filter medium 82. The electrodes of low curvature 86 can be seen to project both upstream and downstream of the serrated lower edge 90 of the corona discharge electrode 84.

The first and third electrodes 76, 80 are at 0 Volts and the second electrode 78 is at from −4 to −10 kV. The electrodes 76, 78, 80 are connected to a high voltage power supply. The high voltage power supply is generated by a PCB 93 which is preferably located in an exhaust manifold 94.

The electrodes 76, 78, 80 may be formed from any suitable conductive material, for example aluminium.

Figure 6B:
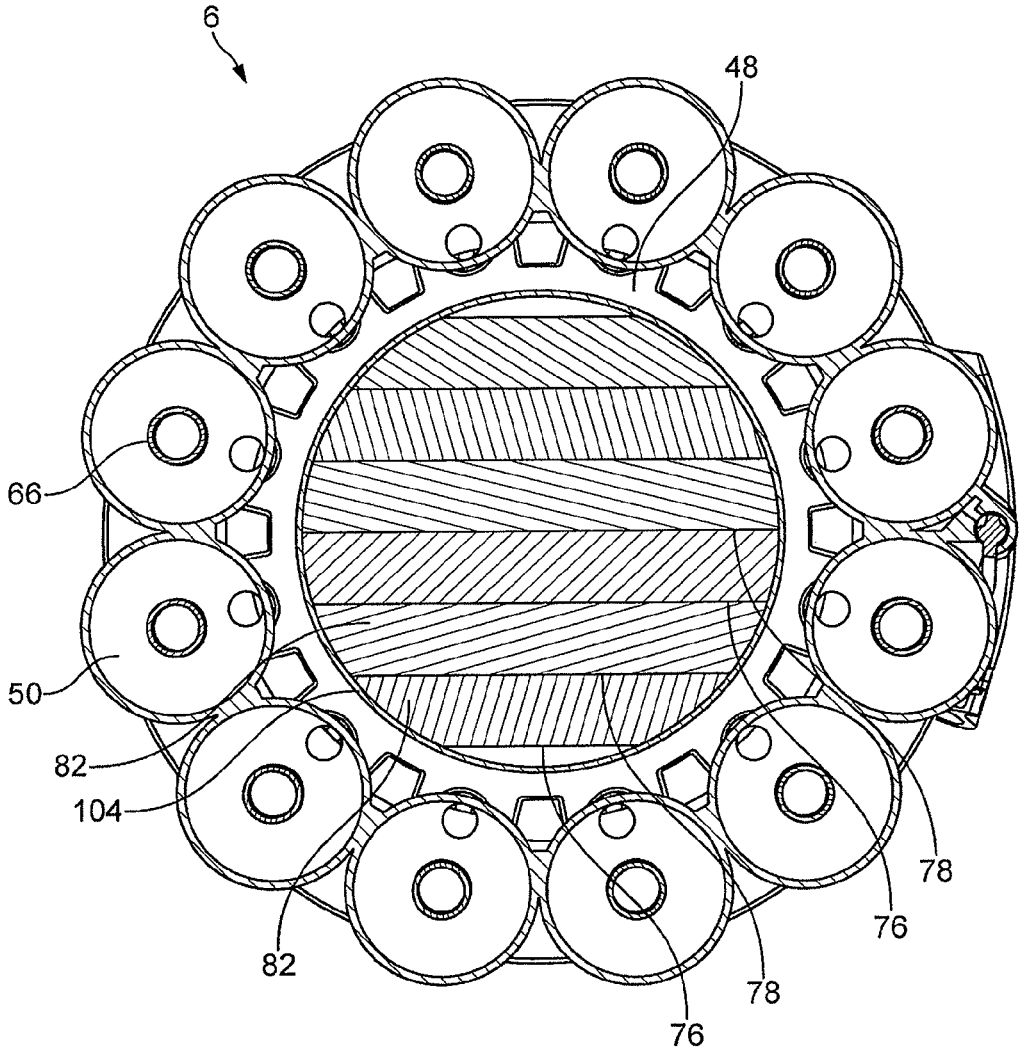
FIG. 6*b* is a horizontal section through the embodiment shown in FIG. 6*a*.

In the embodiment shown in FIGS. 6*a* and 6*b* the electrostatic filter 70 comprises a plurality of first and second flat plate electrodes 76, 78 which are arranged in parallel. Filter media 82 is located between each adjacent first and second electrodes 76, 78 to form a layered electrostatic filter 70. The electrostatic filter 70 may be any shape in cross section but is preferably cylindrical. The first and second electrodes 76, 78 are arranged inside the third cylindrical wall 54 which provides a tubular passageway which forms an outer surface of the electrostatic filter 70. The first and second electrodes 76, 78 are arranged longitudinally to provide a plurality of parallel air passages which run longitudinally through the electrostatic filter 70.

The electrostatic filter 70 also comprises a corona discharge means in the form of corona discharge electrodes 84 and electrodes of low curvature 86. The electrostatic filter 70 would however function without the corona discharge means. Each electrode of low curvature 86 is an extension of a first electrode 76 above the upper surface 102 of the filter media 82. The corona discharge electrodes 84 are in the form of serrated upper edges 91 of the second electrodes 78 which extend above the upper surfaces 102 of the filter medium 82. The electrodes of low curvature 86 can be seen to project both upstream and downstream of the serrated upper edges 91 of the corona discharge electrodes 84.

The first electrodes 76 are at 0 Volts and the second electrodes 78 are at from −4 to −10 kV. The electrodes 76, 78 are connected to a high voltage power supply.

In FIG. 7 it can be seen that the electrostatic filter 70 described above has been replaced with an alternative type of electrostatic filter 70. In this embodiment the electrostatic filter 70 may be a frictional electrostatic filter or an electret medium electrostatic filter 70.

This electrostatic filter 70 could of course be replaced by an electrostatic filter 70 as described in relation to FIGS. 3*a*, 3*b*, 4, 5, 6*a* and 6*b*. Equally the electrostatic filter 70 described in FIGS. 3*a*, 3*b*, 4, 5, 6*a* and 6*b* could be replaced with a different type of electrostatic filter 70, for example a frictional electrostatic filter or an electret medium filter.

During use of the embodiments described above dust laden air enters the separating apparatus 6 via the dust laden air inlet 40 and, because of the tangential arrangement of the inlet 40, the dust laden air follows a helical path around the outer wall 24. Larger dirt and dust particles are deposited by cyclonic action in the annular chamber 38 and collected in the dust collecting bin 34. The partially-cleaned dust laden air exits the annular chamber 38 via the perforations 46 in the shroud 42 and enters the passageway 48. The partially-cleaned dust laden air then passes into tangential inlets 52 of the secondary cyclones 50. Cyclonic separation is set up inside the secondary cyclones 50 so that separation of some of the dust particles which are still entrained within the airflow occurs. The dust particles which are separated from the airflow in the secondary cyclones 50 are deposited in the second annular chamber 58 which forms at least part of the dust collecting bin 64 of the second cyclonic cleaning stage 22. The further cleaned dust laden air then exits the secondary cyclones 50 via the vortex finders 66. The further cleaned dust laden air then passes into the electrostatic filter 70.

In the embodiment shown in FIGS. 3*a* and 3*b*, the further cleaned dust laden air passes out of the vortex finders 66, along the vortex fingers 68 and down the air passage 74 towards the lower end of the electrostatic filter 70. The air then travels past the corona discharge means formed from the corona discharge electrode 84 and the electrodes of low curvature 86 such that any dust particles remaining in the further cleaned dust laden air become charged. The further cleaned dust laden air containing the charged dust then travels upwardly through the filter medium 82. A potential difference is generated across the filter medium 82 causing the charged dust particles to be attracted to respective positive and negative ends of the filter medium 82, thus trapping them within the filter medium 82.

The cleaned air then leaves the top of the electrostatic filter 70 via apertures 92 in the vortex finder plate 56 and enters the exhaust manifold 94. The cleaned air then exhausts the separating apparatus 6 via the exit port 96.

In the embodiment shown in FIG. 5, the further cleaned dust laden air passes out of the vortex finders 66, along the vortex fingers 68 and down the air passage 74 towards the bottom end of the electrostatic filter 70. The air then travels past the corona discharge means formed from the corona discharge electrode 84 and the electrodes of low curvature 86 such that any dust particles remaining in the further cleaned dust laden air become charged. The further cleaned dust laden air containing the charged dust then travels upwardly through the filter medium 82. A potential difference is generated across the filter medium 82 causing the charged dust particles to be attracted to respective positive and negative ends of the filter medium 82, thus trapping them within the filter medium 82.

The cleaned air then leaves the top of the electrostatic filter 70 and enters the exhaust passage 100 which directs air downwardly through the centre of the separating apparatus 6 to the exit port 96 which is located on the lower end of the separating apparatus 6.

In the embodiment shown in FIGS. 6*a* and 6*b*, the further cleaned dust laden air passes out of the vortex finders 66 and enters the plenum 98. The air passes through the plenum 98 and enters the top of the electrostatic filter 70. The air then travels past the corona discharge means formed from the corona discharge electrode 84 and the electrodes of low curvature 86 such that any dust particles remaining in the further cleaned dust laden air become charged. The further cleaned dust laden air containing the charged dust then travels downwardly through the filter medium 82. A potential difference is generated across the filter medium 82 causing the charged dust particles to be attracted to respective positive and negative ends of the filter medium 82, thus trapping them within the filter medium 82.

The cleaned air then leaves the lower end of the electrostatic filter 70 and exhausts the separating apparatus 6 via the exit port 96 located on the lower end of the separating apparatus 6.

In the embodiment shown in FIG. 7, the further cleaned dust laden air passes out of the vortex finders 66, along the vortex fingers 68 and into the electrostatic filter 70. The further cleaned dust laden air travels downwardly through electrostatic filter 70. The cleaned air then leaves the lower end of the electrostatic filter 70 and travels up the exhaust passage 100 to exit the separating apparatus 6 via the exit port 96 located on the upper end of the separating apparatus 6.

It will be appreciated from the description that the separating apparatus 6 includes two distinct stages of cyclonic separation and a distinct stage of electrostatic filtration. The first cyclonic cleaning stage 20 comprises a single cylindrical cyclone 32. The relatively large diameter of the outer wall 24 of which means that comparatively large particles of dirt and debris will be separated from the air because the centrifugal forces applied to the dirt and debris are relatively small. Some fine dust will be separated as well. A large proportion of the larger debris will reliably be deposited in the dust collecting bin 34.

There are 12 secondary cyclones 50, each of which has a smaller diameter than the cylindrical cyclone 32 and so is capable of separating finer dirt and dust particles than the cylindrical cyclone 32. They also have the added advantage of being challenged with air which has already been cleaned by the cylindrical cyclone 32 and so the quantity and average size of entrained dust particles is smaller than would otherwise have been the case. The separation efficiency of the secondary cyclones 50 is considerably higher than that of the cylindrical cyclone 32 however some small particles will still pass through the secondary cyclones 50 to the electrostatic filter 70.

In the embodiments described above the filter medium 82 may be formed from any suitable material for example an open cell reticulated polyurethane foam derived from a polyester.

The filter medium 82 has a PPI in the range of 3 to 12 PPI, preferably 8 to 10 PPI and most preferably 3 to 6 PPI. The pore size and PPI of the filter medium 82 shown in FIG. 3*a* varies along its length because it is formed from two sections each having a different pore size and PPI. In the embodiment shown in FIG. 3*a* the upstream portion has a 3 or 8 PPI and the downstream portion has 6 or 10 PPI.

The pore size/diameter may be measured using the following method.

1) Microscopic pictures of the foam structure should be taken through horizontal sections insuring pore consistency.

2) Five individual pores should be selected.

3) The diameter of each pore should be measured to an accuracy of no less than 100 micron and an average should be taken over the 5 pores.

4) This average pore size (pore diameter) is measured in microns or mm.

The pores per inch is calculated by dividing 25400 (1 inch=25400 microns) by the pore diameter in microns.

In the embodiments shown it is preferable that all of the electrodes are non-porous. However, as long as the first and second electrodes are non-porous it is possible that any other electrodes present could be porous if desired.

The invention claimed is:

1. A separating apparatus comprising:

a first cyclonic cleaning stage comprising at least one cyclone, a second cyclonic cleaning stage arranged downstream from the first cyclonic cleaning stage, wherein at least a portion of the second cyclonic cleaning stage is surrounded by the first cyclonic cleaning stage; and an electrostatic filter located downstream of and in fluid communication with the at least one cyclone, wherein at least a portion of the electrostatic filter is located longitudinally through the separating apparatus, at least a portion of the first cyclonic cleaning stage being arranged around the electrostatic filter, and wherein the electrostatic filter is arranged downstream of the second cyclonic cleaning stage.

2. The separating apparatus of claim 1, having a longitudinal axis wherein the longitudinal axis of the electrostatic filter is in line with the longitudinal axis of the separating apparatus.

3. The separating apparatus of claim 1, wherein the electrostatic filter is connected to a high voltage power supply.

4. The separating apparatus of claim 1, wherein the second cyclonic cleaning stage comprises a plurality of secondary cyclones and a dust collecting bin.

5. The separating apparatus of claim 4, wherein the dust collecting bin of the second cyclonic cleaning stage is surrounded by at least a portion of the first cyclonic cleaning stage.

6. The separating apparatus of claim 5, wherein the electrostatic filter is partially or totally surrounded by at least a portion of the second cyclonic cleaning stage.

7. The separating apparatus of claim 1, wherein the first cyclonic cleaning stage, the second cyclonic cleaning stage and the electrostatic filter are arranged concentrically about a common central axis of the separating apparatus.

8. The separating apparatus of claim 1, wherein the electrostatic filter extends from at or near a top edge of the second cyclonic cleaning stage to at or near a base of separating apparatus.

9. The separating apparatus of claim 1, wherein the electrostatic filter further comprises at least one corona discharge means comprising at least one corona discharge electrode of high curvature and at least one electrode of low curvature.

10. The separating apparatus of claim 1, wherein the electrostatic filter further comprises a third electrode.

11. The separating apparatus of claim 10, wherein a further filter medium is located between the second electrode and the third electrode, the second electrode and the third electrode each being at a different voltage during use such that a potential difference is formed across the further filter medium.

12. The separating apparatus of claim 1, wherein the electrostatic filter comprises a plurality of first and second electrodes arranged in parallel wherein filter medium is located between adjacent electrodes, wherein adjacent electrodes are at a different voltage during use such that a potential difference is formed across the filter medium.

13. A vacuum cleaner comprising a separating apparatus according to claim 1.

14. The vacuum cleaner of claim 13, wherein the separating apparatus is removably mounted to a main body of the vacuum cleaner.

15. The separating apparatus of claim 1, wherein the electrostatic filter comprises a filter medium located between a first and a second electrode each at a different voltage during use such that a potential difference is formed across the filter medium.

16. The separating apparatus of claim 15, wherein the first and second electrodes are substantially non-porous.

17. The separating apparatus of claim 15, wherein the filter medium is an electrically resistive filter medium.

18. The separating apparatus of claim 1, wherein at least a portion of the second cyclonic cleaning stage is surrounded by the first cyclonic cleaning stage.

* * * * *